US005162041A

United States Patent [19]

Simmons

[11] Patent Number: 5,162,041

[45] Date of Patent: Nov. 10, 1992

[54] FOOTWEAR DEVICE ALLOWING A WEARER OF ORTHOPEDIC APPARATUS TO GO WITHOUT CONVENTIONAL SHOES

[76] Inventor: Patricia P. Simmons, 309 Fifth St., Monroe City, Mo. 63456

[21] Appl. No.: 767,393

[22] Filed: Sep. 30, 1991

[51] Int. Cl.[5] ..... A61F 13/06

[52] U.S. Cl. ..... 602/65; 36/142; 36/173

[58] Field of Search ..... 128/80 D, 83.5, 166.5, 128/166, 882; 36/145, 155, 142, 159, 160, 173, 164

[56] References Cited

U.S. PATENT DOCUMENTS

| | | | |
|---|---|---|---|
| 1,187,778 | 6/1916 | Paskett | 36/7.5 |
| 1,894,561 | 1/1933 | Guiffre | 36/11.5 |
| 1,976,819 | 10/1934 | Weiler | 128/596 |
| 2,193,943 | 3/1940 | Shea | 36/11.5 |
| 2,633,130 | 3/1953 | Scholl | 128/166.5 |
| 3,683,519 | 8/1972 | Creamer | 36/11.5 |
| 3,800,444 | 4/1974 | Young | 36/11.5 |
| 4,271,605 | 6/1981 | Raczka | 36/7.5 |
| 4,314,412 | 2/1982 | Anderson et al. | 36/11.5 |
| 4,920,664 | 5/1990 | McGregor et al. | 36/11.5 |
| 4,967,750 | 11/1990 | Cherniak | 36/145 |

FOREIGN PATENT DOCUMENTS

| | | | |
|---|---|---|---|
| 0108513 | 8/1927 | Fed. Rep. of Germany | 128/166.5 |

*Primary Examiner*—Richard J. Apley
*Assistant Examiner*—Lynne A. Reichard
*Attorney, Agent, or Firm*—Peter M. Peer

[57] ABSTRACT

A article of footwear for receiving and holding an orthopedic apparatus such as a heel lift or arch support which enables the user of such apparatus to wear it without wearing conventional shoes. The article of footwear has receiving means for receiving and holding an orthopedic apparatus and securing means for securing said article of footwear to about the ankle and heel of the wearer leaving the forefoot and toes unencumbered by the footwear. The article of footwear is preferably formed by sewing together elastic straps.

14 Claims, 2 Drawing Sheets

FOOTWEAR DEVICE ALLOWING A WEARER OF ORTHOPEDIC APPARATUS TO GO WITHOUT CONVENTIONAL SHOES

BACKGROUND OF THE INVENTION

1. Field

The present invention relates to orthopedic devices usually worn in the shoe.

2. State of the Art

Various types of orthopedic devices such as arch supports and heel lifts are well known in the prior art. Orthopedic devices such as arch supports for those with flat feet and heel lifts for those with one leg shorter than the other are normally placed in the shoe of a person suffering from such orthopedic problems.

Heretofore there has not, so far as is known, been provided any means for receiving the benefits of an orthopedic device without wearing conventional shoes.

SUMMARY OF THE INVENTION

An article of footwear worn about the ankle and heel of the foot which holds an orthopedic device next to the plantar surface of the foot is disclosed. The article includes securing means for securing the device around the ankle and heel of a wearer and orthopedic apparatus receiving means such as a pouch for holding an orthopedic apparatus in position along the plantar surface of the wearer's foot with said securing means attached to said receiving means.

The receiving means for receiving and holding the orthopedic apparatus is preferably provided by elastic straps sewn together to form a pouch for receiving said orthopedic apparatus. In a preferred embodiment, the receiving means comprises three straps. A side strap that extends along the front, side, and rear margins of the pouch. The upper and lower margins of the side strap of the pouch are preferably folded over so that both the upper and lower margins extend toward the center of the pouch. Thus the side strap can envelop the perimeter of an orthopedic apparatus. The strap is preferably formed from an elastic cloth that can stretch to receive the orthopedic apparatus, conform to the perimeter shape of the apparatus, then hold it snugly. Two additional straps are attached along the lower margin of the side strap to provide a floor for the pouch and, thus, prevent an orthopedic apparatus contained in the pouch from dropping out. The two additional straps are preferably oriented perpendicular to one another. For example, one may be oriented from the front to the rear margin of the side strap and the other oriented from one side margin to the other.

The preferred securing means for securing the device about the ankle and heel of the wearer also includes three straps. One strap, the anterior foot strap, is attached at either end along the forward portions of opposite side margins of the receiving means. It has upstanding vertical portions that extend upwardly from their point of attachment and bend toward one another forming a horizontal portion that connects the two upright portions. The vertical upright portions are adapted to extend along the sides of the foot and the horizontal portion is adapted to extend across the top of the foot of a wearer. This anterior strap could be comprised of two separate right and left side members removably attached to one another by attachment means.

A second strap, the ankle strap, is oriented horizontally and attached at either end to the upright portions of the anterior strap at either side of the anterior strap. It is adapted to extend rearwardly from the side of the foot, from either side from the upright portions of the forward foot strap, around the sides and behind the ankle of a wearer.

A third strap, the heel strap, extends up from the heel portion of the main member of the orthopedic apparatus receiving means, then around the ankle strap, and then back down to the heel portion. It is adapted to keep the orthopedic device held snugly against the plantar surface of the heel of a wearer.

THE DRAWINGS

FIG. 1 is a perspective view of an embodiment of a device in accordance with the present invention also showing a heel lift within the receiving means of the device and the outline of the ankle and foot of the wearer in broken lines;

FIG. 2, a cross section of the device of FIG. 1 taken along line 2—2 of FIG. 1;

FIG. 3, a perspective view of an alternative embodiment in accordance with the present invention showing an arch support contained in the pouch means of the device; and FIG. 4, a cross section of the device of FIG. 3 taken along line 4—4 of FIG. 3; and FIG. 5, a bottom plan view of the embodiment shown in FIG. 1.

DETAILED DESCRIPTION OF THE ILLUSTRATED EMBODIMENT

Figure 1:
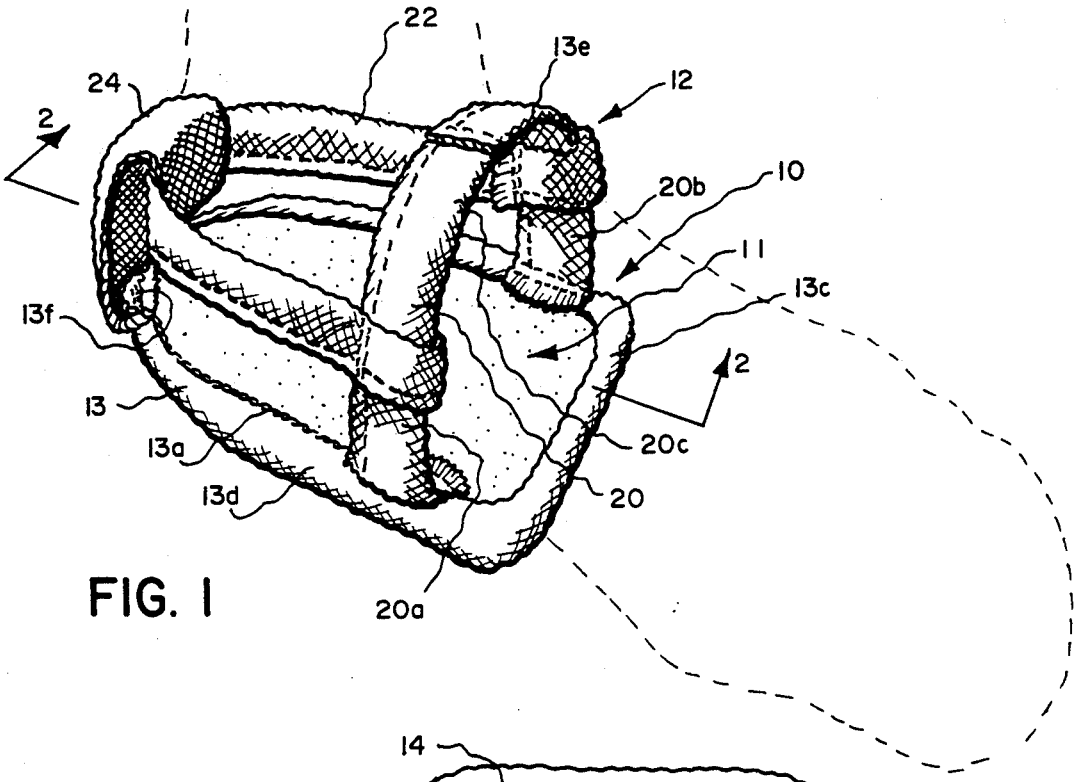

As illustrated in FIG. 1, an article of footwear in accordance with the invention includes orthopedic apparatus receiving means 10 for receiving and holding orthopedic apparatus 11 and securing means 12 for securing the orthopedic device around the ankle and foot of a wearer. The footwear is adapted to be worn about the ankle and heel of a wearer leaving the forefoot and toes unencumbered by any footwear.

Figure 5:
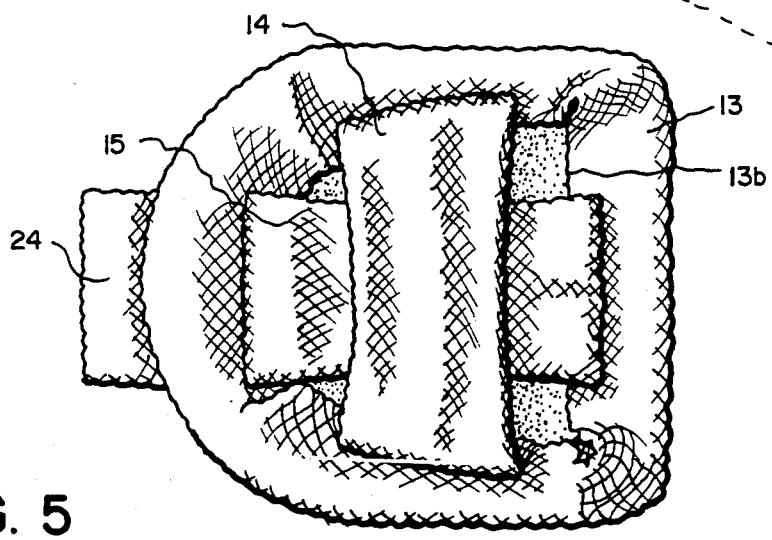
Figure 2:
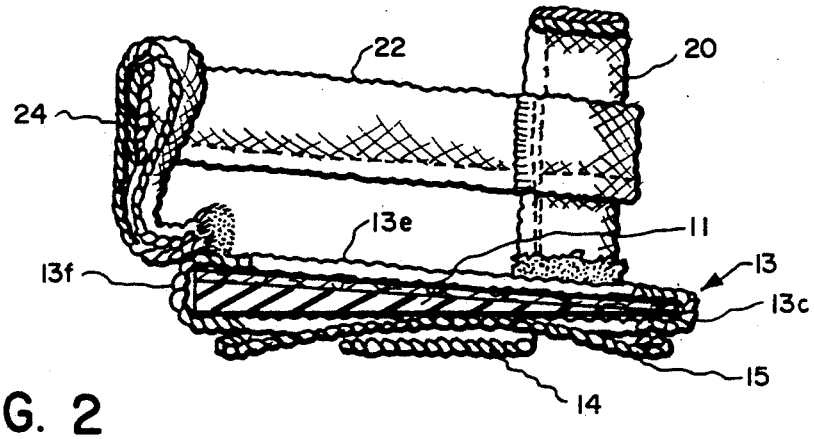

As shown in FIGS. 1, 2 and 5, receiving means 10 includes main member 13 and floor members 14 and 15. Floor members 14 and 15 can be and preferably are perpendicular to one another. The floor members can be oriented from front to rear and side to side, but other orientations will also suffice. Upper margin **13*a* and lower margin 13*b* of main member 13 are folded over toward the center of the receiving means. By being folded over toward the center of the receiving means main member 13 forms a groove for the snug insertion of an orthopedic device. Main member 13 has front portion 13*c*, right side portion 13*d*, left side portion 13*e*, and heel portion 13*f*. As shown in FIG. 1, but perhaps better shown in FIG. 2, orthopedic apparatus 11 fits snugly within the pouch formed by main member 13 and floor members 14 and 15**.

As shown in FIGS. 1 and 2, securing means 12 is formed by anterior foot strap 20, ankle strap 22, and heel strap 24. Anterior foot strap 20 is attached at either end to the forward end of side portions **13*e* and 13*d* of the main member of receiving means 10. Anterior foot strap 20 has upstanding vertical portions 20*a* and 20*b*, which bend centrally to form transverse portion 20*c*. The anterior foot strap helps hold orthopedic apparatus 11 against the plantar surface of the user's foot and also forms vertical portions 20*a* and 20*b* for the attachment of ankle strap 22**.

Figure 3:
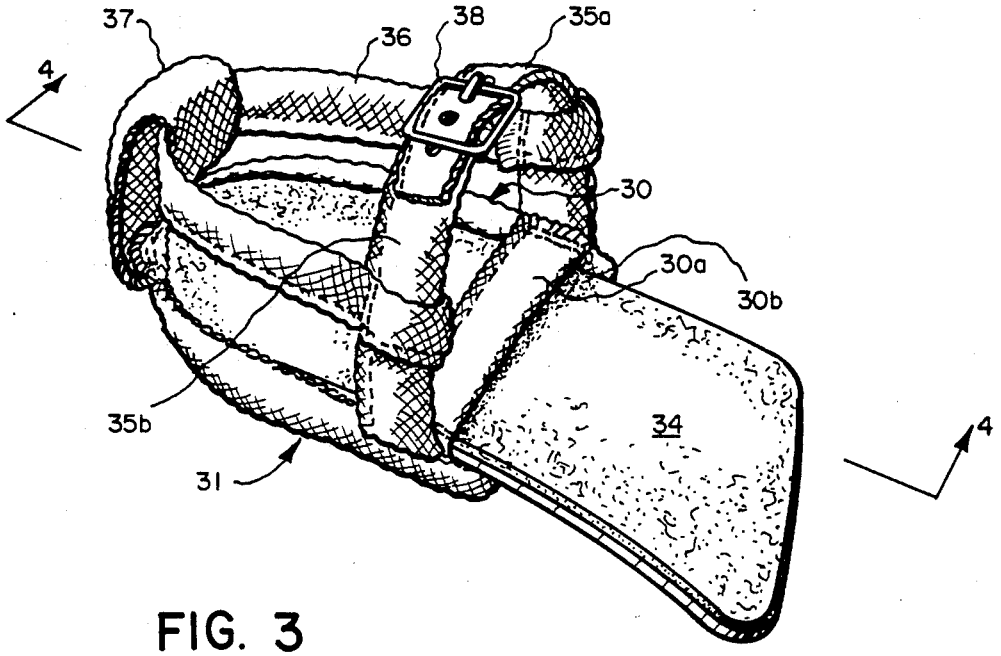

In, an alternative embodiment, as shown in FIG. 3, the anterior foot strap is comprised of 35*b* and 35*a*, respectively, which are removably attached to one another by attachment means, here shown as buckle 38. Such attachment means could be VELCRO strips, i.e., hook and loop securement means, or a buckle or clasps. Forming the anterior strap with two separate members allows the wearer to insert his foot in the footwear and then removably attach the separate side members to one another. If the attachment means is a buckle secured to one side member, the other side member can be adapted to be received by and attached to said buckle. Attaching the two side members to one another provides a more convenient alternative means for putting on the footwear instead of inserting the foot through the device and pulling the device onto the foot as can be done with the embodiment shown in FIG. 1.

As indicated in FIG. 1, at the upper extreme of upstanding vertical portions 20*a* and 20*b*, there are attached the ends of ankle strap 22. From its points of attachment, ankle strap 22 extends rearwardly in the horizontal plane parallel to main member 13 of receiving means 10. Ankle strap 22 is adapted to fit around the ankle of a user.

Heel strap 24 is attaches the ankle strap to heel portion 13*f* of the main member of receiving means 10. It extends upwardly, bends over ankle strap 22, and back down to heel portion 13*f* where it is again attached. Heel strap 24 also helps hold the orthopedic device snugly against the plantar surface of the user's heel.

In another alternative embodiment (also not shown), receiving means 13 could be elongated to extend farther forwardly to receive an orthopedic apparatus such as an arch support without a heel member. In that case, main member 13 could have a median cross member to fit across the rear margin of a heelless arch support and a heel extension strap to extend rearwardly to attach to the heel strap of the securing means. The ankle strap would also be elongated but the anterior foot strap would remain attached to the forward end of the main member of the receiving means and, thus, extend over the foot of the user farther forwardly than as is shown in the embodiment of FIG. 1.

Figure 4:
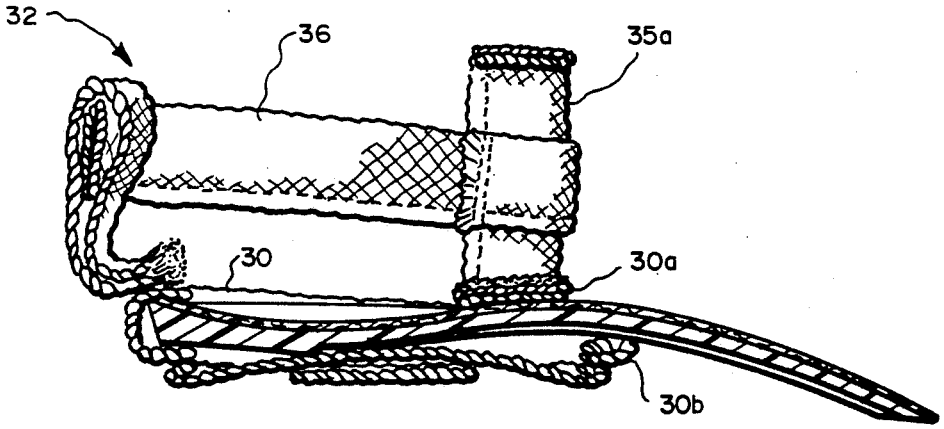

In the alternative embodiment shown in FIGS. 3 and 4, the front portion of main member 30 of receiving means 31 has dual segments forming its front portion including upper front member 30*a* and lower front member 30*b* to allow the passage of longer orthopedic apparatus 34 between the two members. Like the embodiment of FIG. 1, the embodiment of FIGS. 3 and 4 has securing means 32 attached to receiving means 31. Securing means 32 has anterior foot strap 35, ankle strap 36, and heel strap 37.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. An article of footwear, consisting of: orthopedic apparatus receiving means for receiving and holding an orthopedic apparatus and securing means for securing said receiving means to the heel of an orthopedic apparatus user, said securing means being attached to said receiving means wherein the footwear is adapted to be worn about the ankle and heel of a wearer leaving the arch forefoot and toes unencumbered by the article of footwear.

2. The article of footwear of claim 1 wherein the orthopedic receiving means comprises at least one strap.

3. The article of footwear of claim 1 wherein the orthopedic receiving means consists of three straps.

4. The article of footwear of claim 3 wherein the straps are formed from an elastic material.

5. The article of footwear of claim 1 wherein said securing means consists of an anterior foot strap, an ankle strap, and a heel strap.

6. The article of footwear of claim 1 wherein said securing means consists of an anterior foot strap, an ankle strap, and a heel strap, said receiving means having a front margin, side margins, and a rear heel portion, said anterior foot strap having upright vertical portions, the lowermost ends of which are secured along the opposite side margins of said receiving means, said ankle strap secured at either end along the upright vertical portion of said anterior strap, said heel strap extending upwardly from the heel portion of said receiving means to said ankle strap, wherein it attaches said receiving means to said ankle strap.

7. The article of footwear of claim 6 wherein the anterior foot strap is comprised of separate right and left side members and there is additionally included attachment means for removably attaching the right and left side members to one another.

8. The article of footwear of claim 7 wherein the attachment means are a corresponding pair of hook and loop securement strips secured to the right and left side members of the anterior foot strap.

9. The article of footwear of claim 7 wherein the attachment means is a buckle attached to one of said side members of the anterior strap and wherein the opposite side member is adapted to be received by and removably secured to said buckle.

10. An article of footwear for securing an orthopedic device containing a heel lift to the heel of a wearer, consisting of orthopedic apparatus receiving pouch for receiving and holding an orthopedic apparatus containing a heel lift, said receiving pouch comprised of a main member having a front portion, right and left side portions, and a rear heel portion; said main member being folded over so as to form upper and lower margins and adapted to be worn between the front and rear margins of the heel of a wearer;

an anterior foot strap having upright vertical portions, the lowermost ends of which are secured along the right and left side portions of said receiving pouch;

an ankle strap secured at either end along the upright vertical portion of said anterior strap; and a heel strap secured at one end to the heel portion of said receiving pouch and at the other end to said ankle strap;

said article of footwear adapted to hold the heel lift portion of an orthopedic device securely to the heel of a wearer and leaving the arch, forefoot, and toes of the wearer unencumbered.

11. An article of footwear according to claim 10, wherein the orthopedic apparatus receiving pouch is comprised of three straps, a main member strap being folded over to have upper and lower margins and having a front portion, a rear heel portion, and left and right side portions, a first floor member strap having its opposite ends attached at opposite lower margins of said main member strap, and a second floor member strap oriented roughly perpendicular to said first floor member strap and having its opposite ends attached to opposite lower margins of said main member strap.

12. An article of footwear according to claim 11, wherein the respective ends of the first floor member strap are attached to the lower margins of the front and rear portions of said main member strap, and the respective ends of the second floor member strap are attached to opposite lower margins of the left and right side portions of said main member strap.

13. An article of footwear according to claim 10, wherein the anterior foot strap is comprised of separate right and left side members and there is additionally included attachment means for removably attaching the right and left side members to one another.

14. An article of footwear according to claim 10, wherein the front margin of said main member strap is formed into upper and lower sections to allow insertion of an orthopedic apparatus between said upper and lower sections.

* * * * *